US008849164B2

(12) United States Patent
Teramura

(10) Patent No.: US 8,849,164 B2
(45) Date of Patent: Sep. 30, 2014

(54) DEVELOPER STORAGE BODY, DEVELOPING DEVICE AND IMAGE FORMING APPARATUS

(75) Inventor: Osamu Teramura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 740 days.

(21) Appl. No.: 13/064,712

(22) Filed: Apr. 11, 2011

(65) Prior Publication Data

US 2011/0255906 A1 Oct. 20, 2011

(30) Foreign Application Priority Data

Apr. 16, 2010 (JP) ..... 2010-094706

(51) Int. Cl.
*G03G 15/08* (2006.01)

(52) U.S. Cl.
CPC ..... *G03G 15/0832* (2013.01); *G03G 2215/085* (2013.01)
USPC ..... 399/263; 399/262

(58) Field of Classification Search
USPC ..... 399/263
See application file for complete search history.

(56) References Cited

U.S. PATENT DOCUMENTS 5,612,770 A * 3/1997 Bandai et al. ..... 399/254
2002/0122676 A1* 9/2002 Yamada et al. ..... 399/263
2006/0051135 A1 3/2006 Sato et al.
2008/0260441 A1 10/2008 Takagi et al.
2009/0087227 A1* 4/2009 Takagi et al. ..... 399/263

FOREIGN PATENT DOCUMENTS

| | | | | |
|---|---|---|---|---|
| EP | 0 714 050 A1 | | 5/1996 | |
| JP | 4-191768 | | 7/1992 | |
| JP | 9-197823 | | 7/1997 | |
| JP | H09-197823 A | * | 7/1997 | ..... G03G 15/08 |
| JP | 10-48938 | | 2/1998 | |
| JP | 2002-229316 | | 8/2002 | |
| JP | 2006-276810 | | 10/2006 | |
| JP | 2007-233365 A | | 9/2007 | |
| JP | 2008-89666 | | 4/2008 | |
| JP | 2008-90105 | | 4/2008 | |
| JP | 2008-111900 | | 5/2008 | |

* cited by examiner

*Primary Examiner* — Clayton E Laballe
*Assistant Examiner* — Jas Sanghera
(74) *Attorney, Agent, or Firm* — Rabin & Berdo, P.C.

(57) ABSTRACT

A developer storage body includes a developer storage portion storing a developer and having an elongated shape, an outlet opening provided at a substantially center portion of the developer storage portion in a longitudinal direction of the developer storage portion, inclined portions provided on both end portions of the developer storage portion in the longitudinal direction, a rotation member rotatably provided in the developer storage portion, and a film member provided on the rotation member. The film member is brought into contact with the inclined portions when the rotation member rotates.

18 Claims, 11 Drawing Sheets

DEVELOPER STORAGE BODY, DEVELOPING DEVICE AND IMAGE FORMING APPARATUS

BACKGROUND OF THE INVENTION

The present invention relates to an image forming apparatus using electrophotography such as a printer, a facsimile machine or a combined machine. Further, the present invention relates to a developer storage body for storing a developer, and a developing device having the developer storage body.

An image forming apparatus using electrophotography is configured to form an image by uniformly charging a surface of a photosensitive body, exposing the surface of the photosensitive body to form a latent image, developing the latent image using a developing device to form a developer image (i.e., a toner image), and to transfer the developer image from the photosensitive body to a printing medium. Generally, the developing device has a detachable developer storage body for supplying the developer to the developing device.

In this regard, the developer may adhere to an inner surface of the developer storage body and an opening-and-closing member provided therein. In such cases, the developer storage body cannot supply a sufficient amount of the developer to the developing device.

Therefore, Patent Document 1 discloses a developer storage body having a mechanism that scrapes off the developer from the inner surface of the developer storage body and the like.

Patent Document 1: Japanese Laid-open Patent Publication No. 2007-233365 (see paragraph 0031)

However, there are still cases where the developer remains in the developer storage body. In such cases, the developer stored in the developer storage body is not sufficiently supplied to the developing device, and is therefore not effectively used.

SUMMARY OF THE INVENTION

In an aspect of the present invention, it is intended to reduce an amount of a developer left in a developer storage body and to achieve effective use of the developer.

According to an aspect of the present invention, there is provided a developer storage portion storing a developer and having an elongated shape, an outlet opening provided at a substantially center portion of the developer storage portion in a longitudinal direction of the developer storage portion, inclined portions provided on both end portions of the developer storage portion in the longitudinal direction, a rotation member rotatably provided in the developer storage portion, and a film member provided on the rotation member. The film member is brought into contact with the inclined portions when the rotation member rotates.

With such a configuration, an amount of the developer left in the developer storage body can be reduced, and the developer can be effectively used.

According to another aspect of the present invention, there is provided a developing device including the above described developer storage body.

According to still another aspect of the present invention, there is provided an image forming apparatus including the above described developing device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

Figure 1:
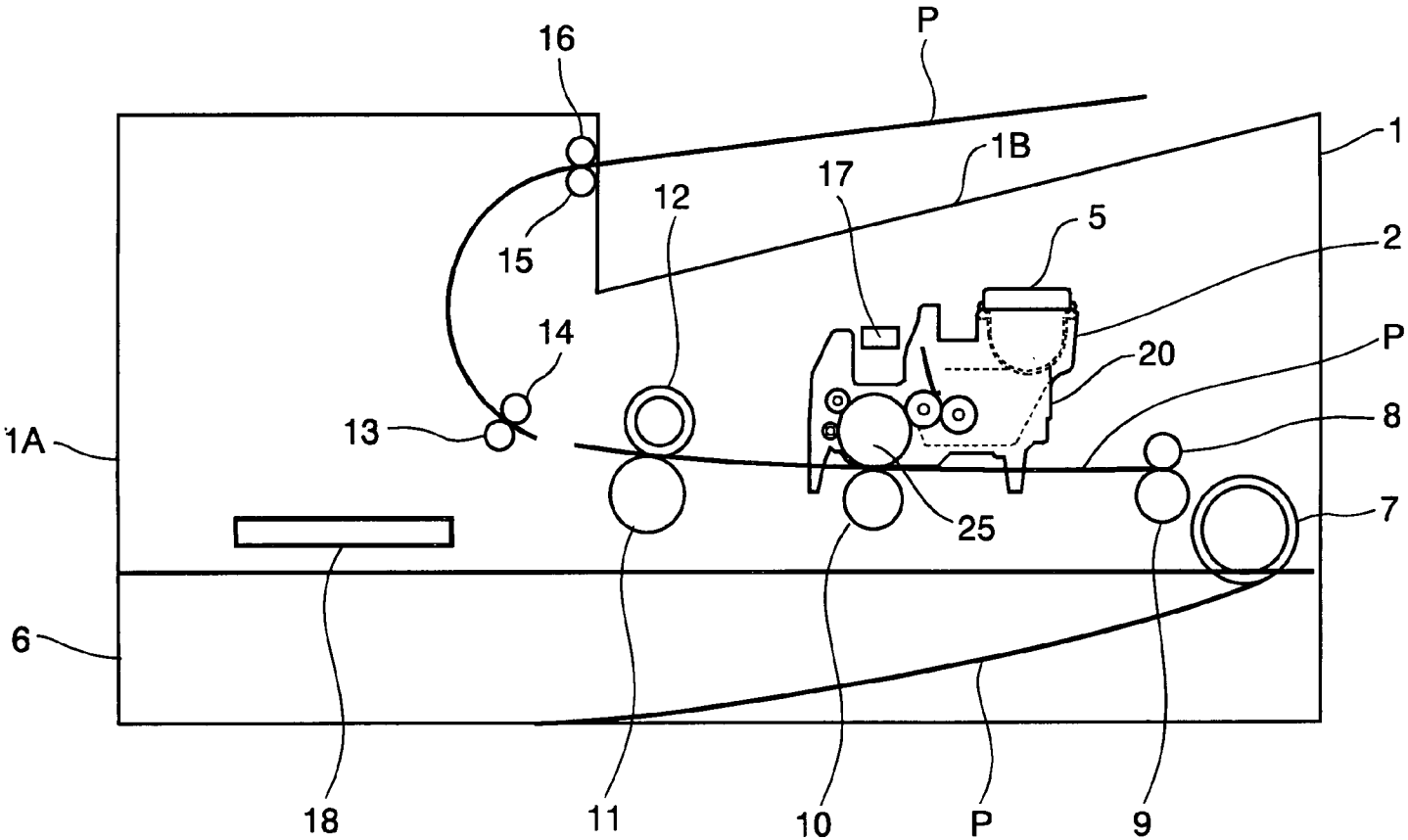
FIG. 1 is a schematic sectional view showing a configuration of an image forming apparatus according to the first embodiment of the present invention.

FIG. 1 is a schematic sectional view showing a configuration of an image forming apparatus 1 according to the first embodiment of the present invention.

The image forming apparatus 1 includes an image forming unit (also referred to as a process cartridge) 2 that forms an image on a printing medium P using a toner as a developer, and a housing 1A in which the image forming unit 2 is detachably mounted. A medium feeding path is formed in the housing 1A through which the printing medium P is fed. The medium feeding path is substantially S-shaped, and extends through the image forming unit 2.

Although the image forming apparatus 1 is described herein as being configured to include a single image forming unit 2 and to form a monochrome image (for example, black image) for convenience of explanation, it is also possible to configure the image forming apparatus 1 to include a plurality of image forming units 2 so as to form a color image.

A cassette 6 (i.e., a printing media storage portion) is detachably mounted to a lower part of the image forming apparatus 1. The cassette 6 stores a stack of the printing media P such as printing sheets. A hopping roller 7 (i.e., a medium feeding mechanism) is provided above the cassette 6 for feeding the printing. medium P one by one out of the cassette 6. A pair of registration rollers 8 and 9 (i.e., a conveying mechanism) are provided in the vicinity of the hopping roller 7. The registration rollers 8 and 9 convey the printing medium P (fed out of the cassette 6 by the hopping roller 7) toward the image forming unit 2.

A transfer member 10 (for example, a transfer roller) is provided so as to face a photosensitive drum 25 (described later) of the image forming unit 2 via the medium feeding path. The transfer member 10 is applied with a transfer voltage by a high voltage power source, and transfers a toner image (i.e., a developer image) formed by the image forming unit 2 to the printing medium P.

A fixing unit is provided on a downstream side (i.e., left in FIG. 1) of the image forming unit 2 along the medium feeding path. The fixing unit includes a heat roller 11 and a backup roller 12 that nip the printing medium P therebetween. The heat roller 11 has a heat source therein. The heat roller 11 and the backup roller 12 apply heat and pressure to the printing medium P (to which the toner image is transferred) to thereby fix the toner image to the printing medium P.

A pair of ejection rollers 13 and 14 and another pair of ejection rollers 15 and 16 are provided on a downstream side of the fixing unit (11, 12) along the medium feeding path. The ejection rollers 13, 14, 15 and 16 convey the printing medium P (to which the toner image is fixed) and eject the printing medium P outside the housing 1A. A stacker portion 1B is formed on an upper part of the housing 1A for placing the printing medium P thereon.

The image forming apparatus 1 further includes a control circuit board 18 (i.e., a control unit) on which a CPU or the like is mounted for controlling an image forming operation of the image forming apparatus 1.

Figure 2:
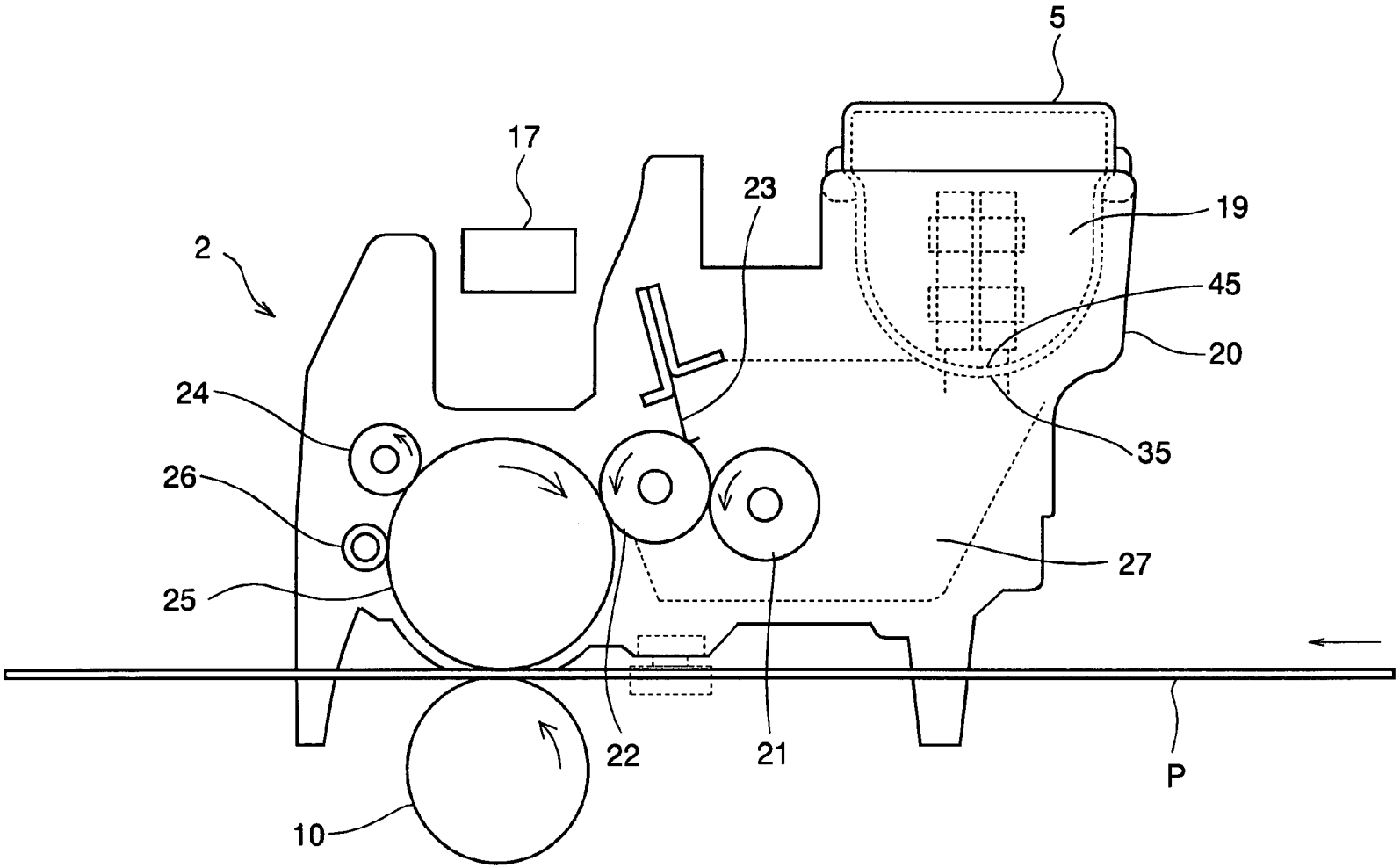
FIG. 2 is a schematic view showing an image forming unit according to the first embodiment.

FIG. 2 is a schematic view showing the image forming unit 2 together with an exposure device 17 and the transfer member 10. The image forming unit 2 includes a photosensitive drum 25 as an image bearing body on which a latent image is formed by the exposure device 17 as described later. The photosensitive drum 25 includes a metal shaft (i.e., a conductive supporting body) and a photoconductive layer formed on the metal shaft. The photoconductive layer contains, for example, a charge generation layer, a charge transport layer and the like. The photosensitive drum 25 rotates clockwise in FIG. 2 at a constant circumferential speed.

The image forming unit 2 includes a charging member (i.e., a charging roller) 24 that uniformly charges the surface of the photosensitive drum 25, a developing member (i.e., a developing roller) 22 that develops a latent image formed on the surface of the photosensitive drum 25, and a supplying member (i.e., a supplying roller) 21 that supplies the toner to the surface of the developing member 22. The image forming unit 2 further includes a blade 23 that regulates a thickness of a toner layer formed on the surface of the developing member 22, and a cleaning member that removes the residual toner remaining on the photosensitive drum 25.

The charging member 24 includes, for example, a metal shaft and a conductive resilient layer formed on a circumferential surface of the metal shaft. The charging member 24 rotates contacting the photosensitive drum 25. The developing member 22 includes, for example, a metal shaft and a conductive resilient layer formed on a circumferential surface of the metal shaft. A coating can be applied to a surface of the conductive resilient layer as necessary. The developing member 22 rotates contacting the surface of the photosensitive drum 25. The blade 23 is constituted by, for example, a metal plate member which is bent. A bent portion of the blade 23 is pressed against the surface of the developing member 22 with a uniform pressing force. The cleaning member 26 includes, for example, a rubber roller or blade, and is provided so as to contact the surface of the photosensitive drum 25. The charging member 24, the developing member 22 and the supplying member 21 are respectively applied with a charging voltage, a developing voltage and a supplying voltage by not shown high voltage power sources.

The developing member 22, the supplying member 21 and the blade 23 constitute a developing device 20 that develops the latent image on the surface of the photosensitive drum 25. The developing device 20 has a toner holding space 27 as a developer holding space in which the developing member 22, the supplying member 21 and the blade 23 are provided.

The developing device 20 further includes a toner cartridge 5 as a developer storage body. The toner cartridge 5 is detachably mounted to a part above the toner holding space 27. An inner space of the toner cartridge 5 is referred to as a toner storage portion 19 as a developer storage portion. The toner is stored in the toner storage portion 19, and is supplied to the toner holding space 27 of the developing device 20 when a toner supply opening 35 (described later) is opened.

The exposure device 17 is provided above the photosensitive drum 25 of the image forming unit 2. The exposure device 17 emits light to expose the surface of the photosensitive drum 25 so as to form a latent image. The exposure device 17 includes, for example, an LED (Light Emitting Diode) head, and is fixed to an upper cover of the image forming apparatus 1.

Next, a basic operation of the image forming apparatus 1 will be described. In FIG. 2, the toner is supplied from the toner cartridge 5 to the toner holding space 27 of the developing device 20, and is supplied to the developing member 22 by the supplying member 21. The toner layer is formed on the surface of the developing member 22, and a thickness of the toner layer is regulated by the blade 23. Further, the charging roller 24 uniformly charges the surface of the photosensitive drum 25, and the exposure device 17 emits light to selectively expose the surface of the photosensitive drum 25, so that the latent image is formed thereon. The latent image is developed with the toner by the developing member 22, so that the toner image is formed on the surface of the photosensitive drum 25.

In FIG. 1, the printing medium P stored in the cassette 6 is fed by the hopping roller 7 out of the cassette 6, and is conveyed by the registration rollers 8 and 9 to reach the image forming unit 2. Then, the toner image on the surface of the photosensitive drum 25 is transferred to the printing medium P by the transfer member 10. The residual toner remaining on the surface of the photosensitive drum 25 after the transferring of the tone image is removed by the cleaning member 26 (FIG. 2).

The printing medium P to which the toner image is transferred is conveyed to the fixing unit (11, 12). The printing medium P is heated and pressed by the heat roller 11 and the backup roller 12, and the toner image is fixed to the printing medium P. The printing medium P to which the toner image is fixed is ejected out of the housing 1A by the ejection rollers 13, 14, 15 and 16. The ejected printing medium P is placed on the stacker portion 1B. The above described operation is controlled by the control circuit board 18.

Figure 3:
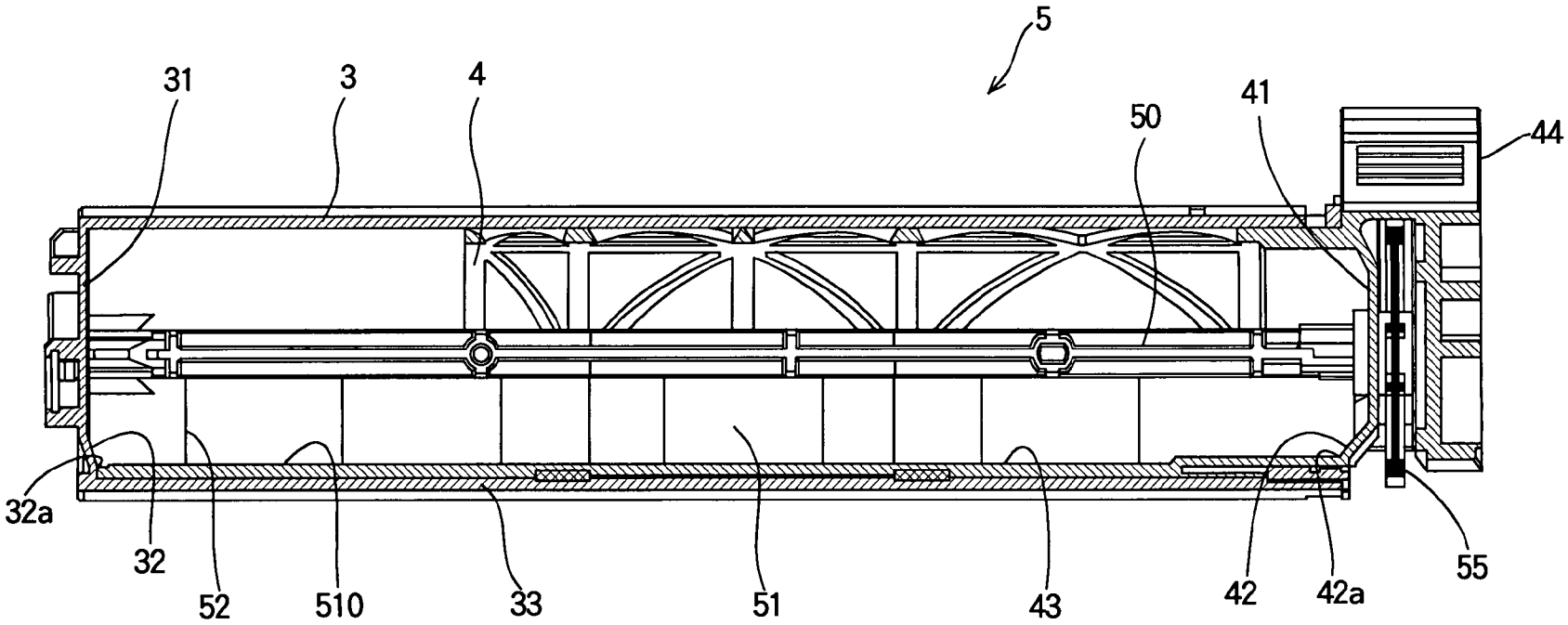
FIG. 3 is a sectional view showing a toner cartridge according to the first embodiment.
Figure 4:
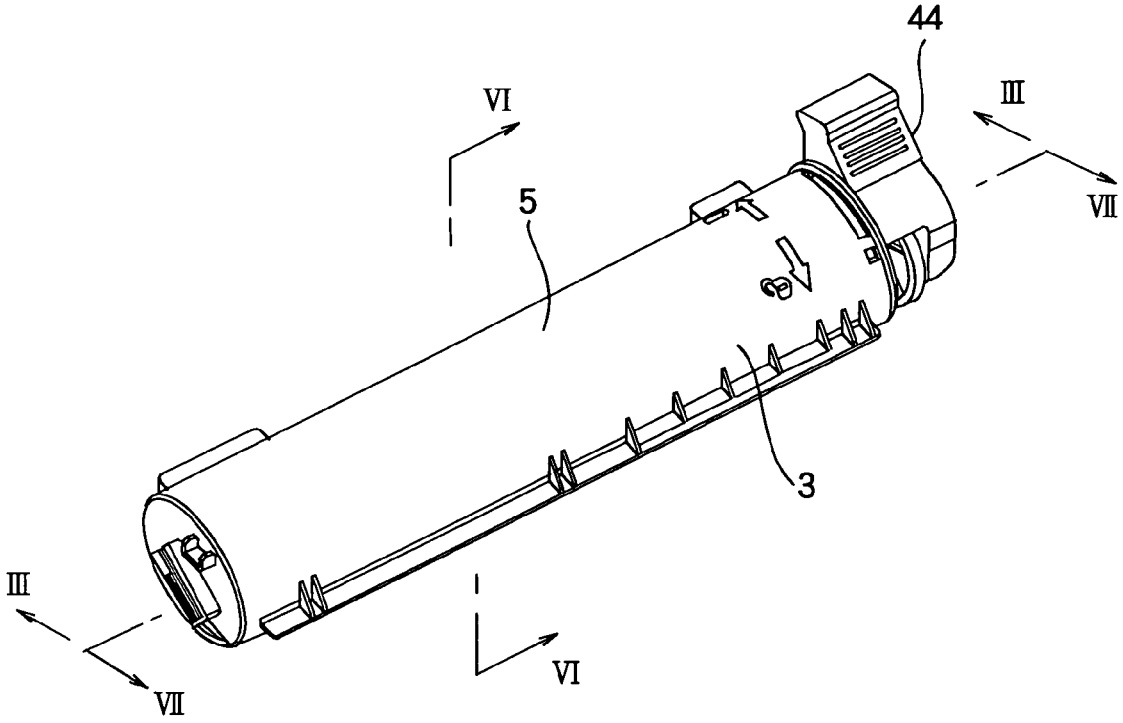
FIG. 4 is a perspective view showing an outer shape of the toner cartridge according to the first embodiment.
Figure 5:
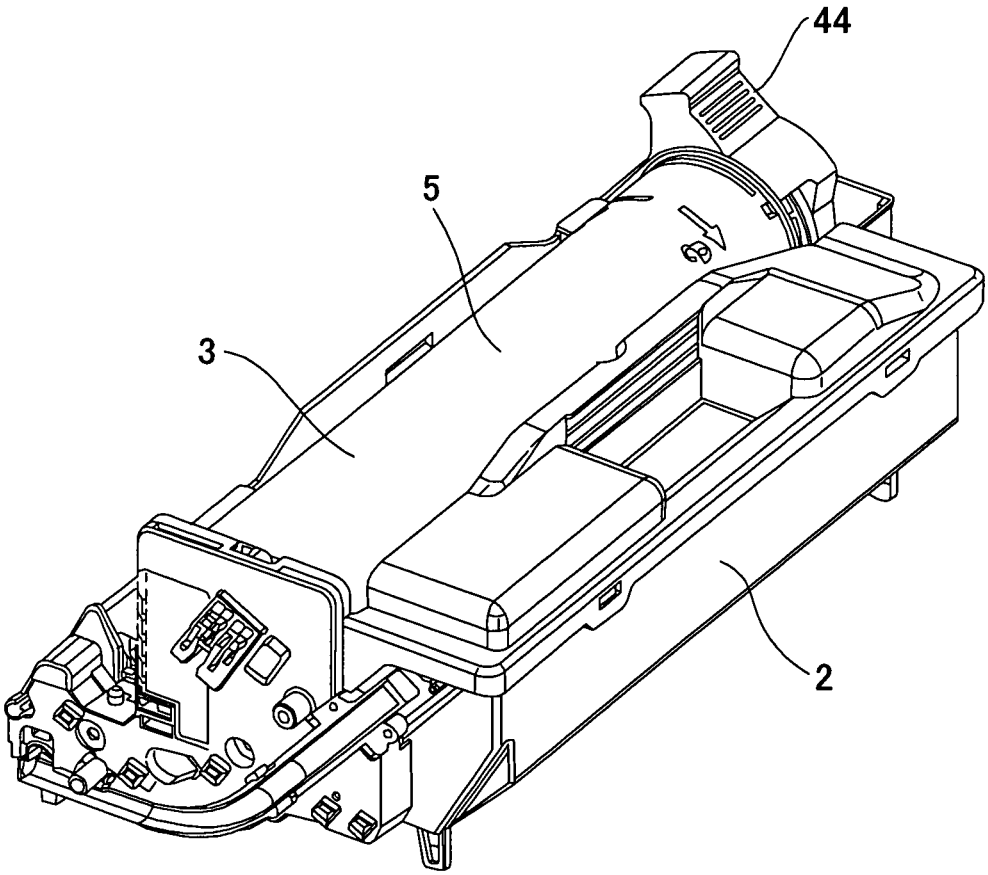
FIG. 5 is a perspective view showing the toner cartridge mounted to the image forming unit according to the first embodiment.

FIGS. 3 and 4 are a sectional view and a perspective view showing the toner cartridge 5. In this regard, FIG. 3 corresponds to a sectional view taken along line in FIG. 4. FIG. 5 is a perspective view showing an external shape of the toner cartridge 5 mounted to the image forming unit 2 (i.e., the process cartridge). As shown in FIG. 3, the toner cartridge 5 includes an outer case 3 and an inner case 4. The outer case 3 forms an outermost housing of the toner cartridge 5. The inner case 4 (as an opening-and-closing member) is provided inside the outer case 3.

The outer case 3 is in the form of a container, and has a substantially cylindrical shape extending parallel to an axial direction of the photosensitive drum 25 (FIG. 2). The outer case 3 includes a cylindrical wall 33 having a substantially cylindrical shape. The outer case further includes a closed end (referred to as a side wall 31) provided at an end of the cylindrical wall 33 in the longitudinal direction. The other end of the cylindrical wall 33 is opened. The outer case 3 has a toner supply opening 35 (FIG. 6) formed at a lower part of a center portion of the cylindrical wall 33 in the longitudinal direction. The toner is ejected via the toner supply opening 24 and is supplied to the image forming unit 2 (the developing device 20).

The inner case 4 has a substantially cylindrical shape, and is provided inside the outer case 3 so that the inner case 4 is rotatable contacting an inner circumferential surface of the outer case 3. The inner case 4 includes a cylindrical wall 43 having a substantially cylindrical shape. The inner case 4 further includes a closed end (referred to as a side wall 41) provided at an end of the cylindrical wall 43 in the longitudinal direction. The other end of the cylindrical wall 43 is opened. An upper part of the cylindrical wall 43 is formed into a framework structure. The inner case 4 has an opening 45 (FIG. 6) facing the toner supply opening 35 of the outer case 3.

The closed end (i.e., the side wall 41 portion) of the inner case 4 protrudes outward from the opened end of the outer case 3. A lever 44 (as an operating portion) is formed integrally with the protruding portion of the inner case 4. The lever 44 is gripped by a user for operation to rotate the inner case 4. The side wall 31 of the outer case 3 and the side wall 41 of the inner case 4 constitute both ends (i.e., inner end surfaces) of the toner cartridge 5 in the longitudinal direction. Hereinafter, the side walls 31 and 41 are also referred to as "both side walls 31 and 41 of the outer cartridge 5" as necessary.

Figure 6A:
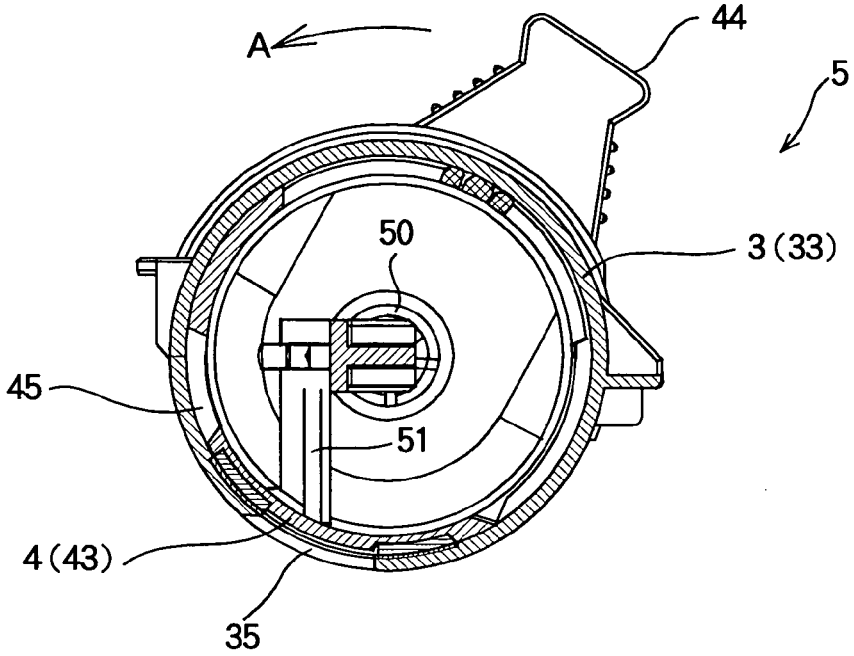
FIGS. 6A and 6B are cross sectional views for illustrating an opening-and-closing operation of a toner supply opening of the toner cartridge according to the first embodiment.
Figure 6B:
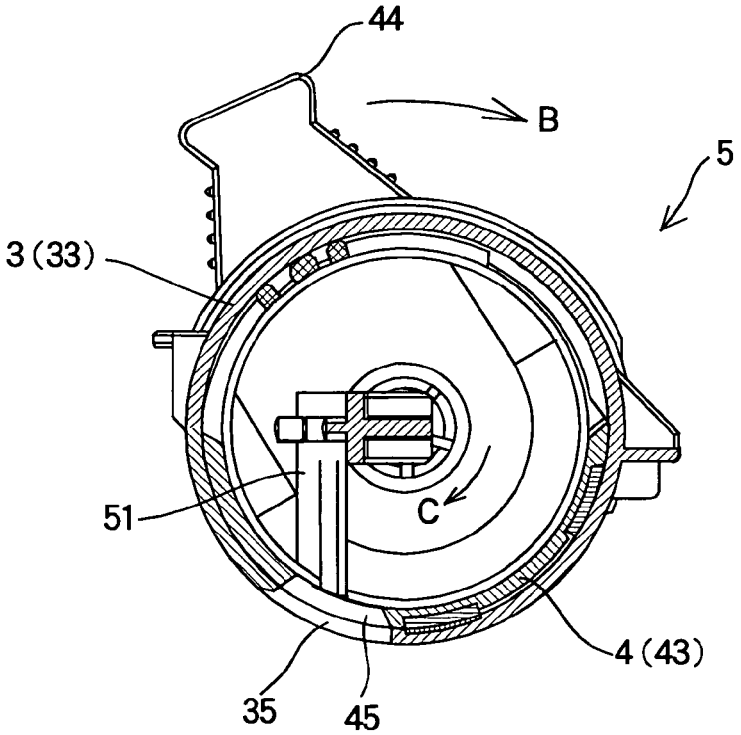

FIGS. 6A and 6B are sectional views of the toner cartridge 5 taken along line VI-VI in FIG. 4. FIG. 6A shows a state where the inner case 4 closes the toner supply opening 35, and FIG. 6B shows a state where the inner case 4 opens the toner supply opening 35. When the toner cartridge 5 is mounted to the image forming unit 2, and when the user rotates the lever 44 in a direction shown by an arrow A (FIG. 6A), the inner case 4 rotates in the direction shown by the arrow A along the inner circumferential surface of the outer case 3. When the opening 45 of the inner case 4 is overlapped with the toner supply opening 35 of the outer case 3, the toner supply opening 35 is opened, and the toner stored in the toner cartridge 5 is supplied to the image forming unit 2.

Further, when the user rotates the lever 44 in a direction shown by an arrow B (FIG. 6B), the inner case 4 rotates in the direction shown by the arrow B along the inner circumferential surface of the outer case 3. When the opening 45 of the inner case 4 is shifted from the toner supply opening 35 of the outer case 3, the toner supply opening 35 is closed.

The toner cartridge 5 has a rotation member 50 inside the inner case 4 as shown in FIG. 3. The rotation member 50 is has an elongated shape along the longitudinal direction of the toner cartridge 5. The rotation member 50 is rotatably supported by both side walls 31 and 41 of the toner cartridge 5. An end of the rotation member 50 penetrates the side wall 41 of the inner case 4. A gear 55 is fixed to a protruding end of the rotation member 50. A rotation of a not shown driving source is transmitted to the gear 55 for rotating the rotation member 50.

A film member 51 is fixed to the rotation member 50. The film member 51 is formed of material having suitable toughness and flexibility such as a polyester film. The film member 51 extends substantially entire length of the rotation member 50. In other words, the film member 51 extends from the vicinity of the side wall 31 to the vicinity of the side wall 41. A tip edge 510 (i.e., a longer edge) of the film member 51 contacts an inner circumferential surface of the cylindrical wall 43 of the inner case 4. When the rotation member 50 rotates, the film member 51 fixed to the rotation member 50 rotates contacting the inner circumferential surface of the inner case 4. The film member 51 is fixed to the rotation member 50 in such a shape that both end portions of the film member 51 in the longitudinal direction are located ahead (in the rotating direction of the film member 51) of a center portion of the film member 51 in the longitudinal direction, as will be described later.

Figure 7:
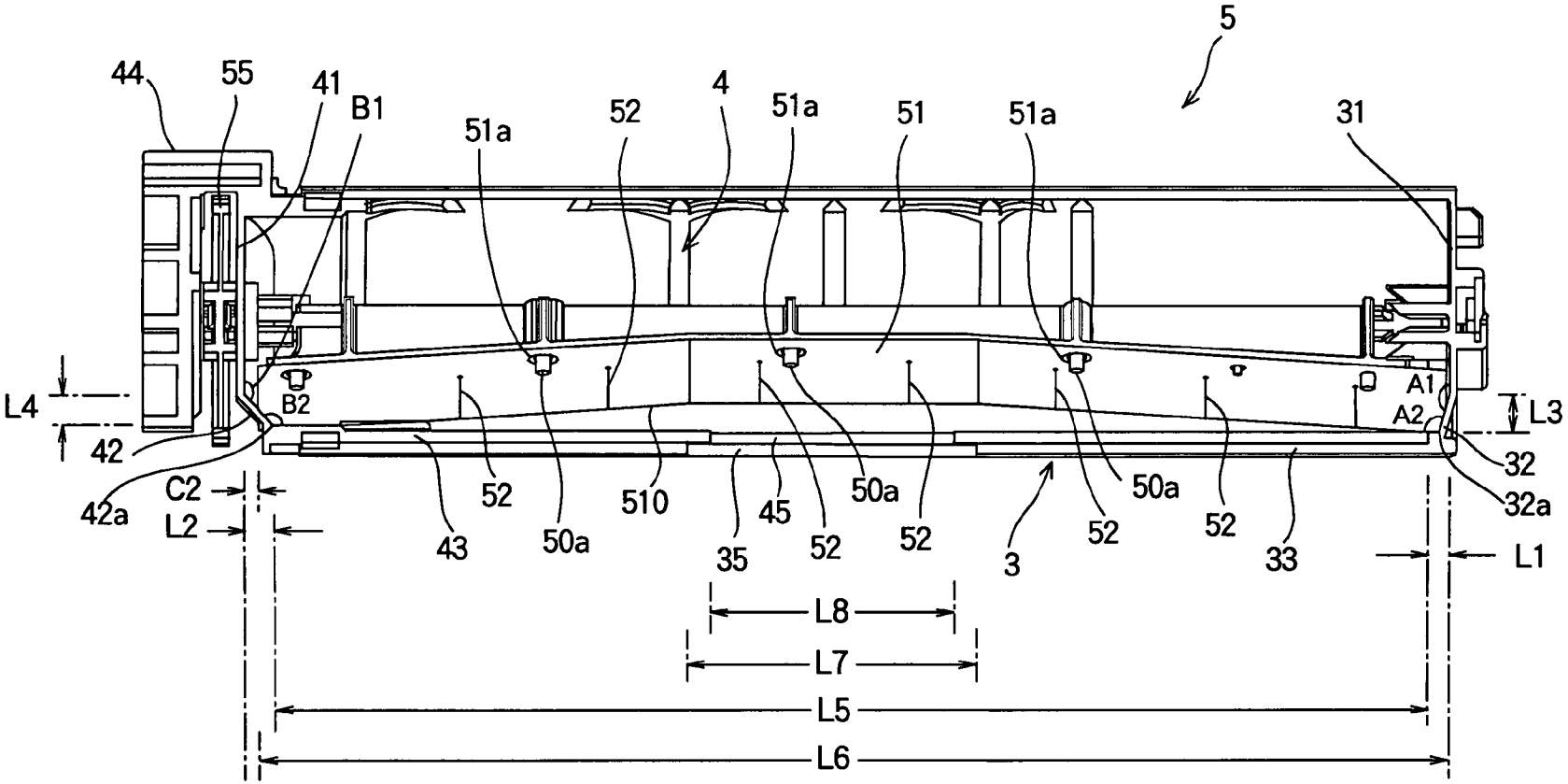
FIG. 7 is a sectional view showing a configuration of the toner cartridge according to the first embodiment.
Figure 8:
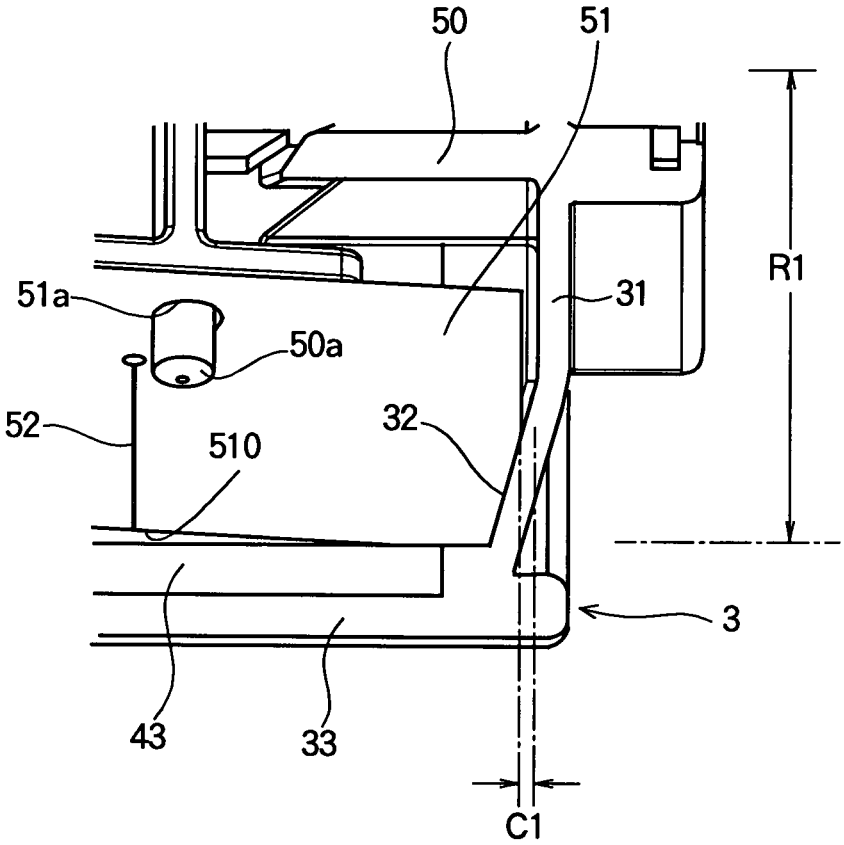
FIG. 8 is an enlarged view showing the vicinity of a side wall of the toner cartridge shown in FIG. 7.
Figure 9C:
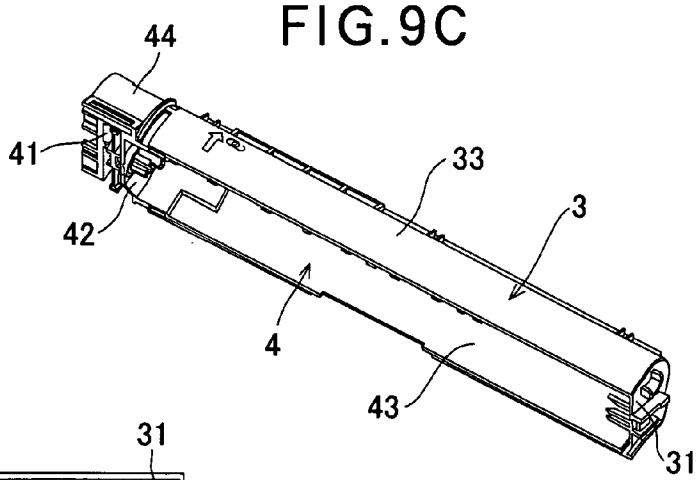
FIGS. 9B and 9C are cutaway perspective views showing the toner cartridge according to the first embodiment.
Figure 9E:
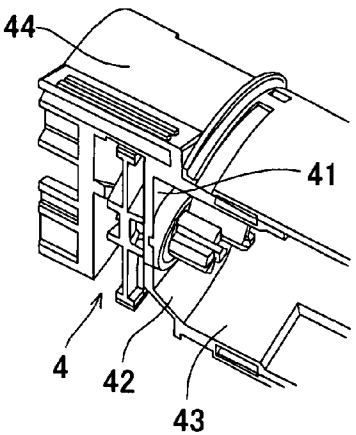
FIGS. 9D and 9E are enlarged perspective views showing the vicinities of respective side walls of the toner cartridge according to the first embodiment.
Figure 9A:
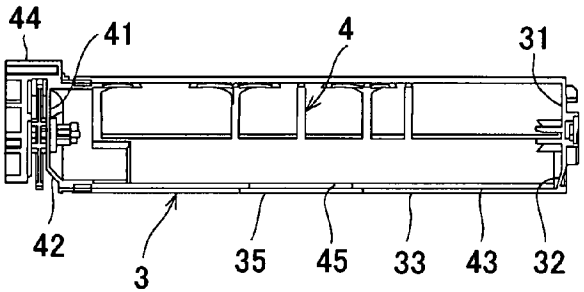
FIG. 9A is a sectional view showing the toner cartridge according to the first embodiment in such a manner that a rotation member and a film member are removed.
Figure 9B:
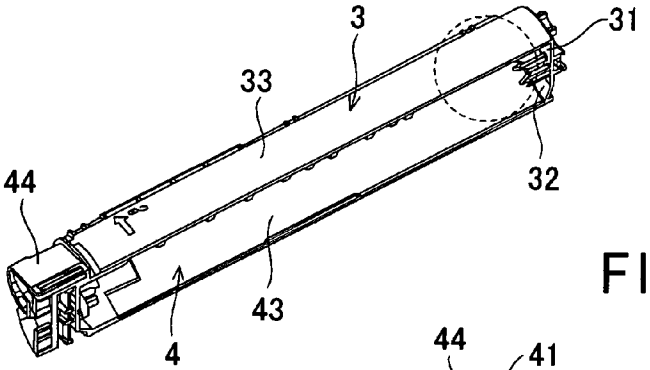
Figure 9D:
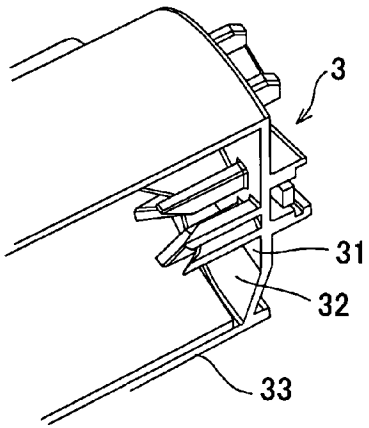

FIG. 7 is a sectional view of the toner cartridge 5 taken along line VII-VII shown in FIG. 4 (i.e., as seen in an opposite direction to FIG. 3). FIG. 8 is an enlarged view showing the vicinity of the side wall 31 of the toner cartridge 5 shown in FIG. 7. FIG. 9A is a sectional view of the toner cartridge 5 in such a manner that the rotation member 50 and the film member 51 are removed therefrom. FIGS. 9B and 9C are cutaway perspective views showing the toner cartridge 5. FIGS. 9D and 9E are enlarged perspective views showing the vicinities of respective side walls 31 and 41 of the toner cartridge 5.

As shown in FIGS. 7, 8, 9D and 9E, inclined portions (slopes) 32 and 42 are formed on both end portions of the toner cartridge 5. More specifically, as shown in FIG. 8, the inclined portion 32 is formed between the side wall 31 and the cylindrical wall 33 of the outer case 3. The inclined portion 32 is inclined with respect to both of the side wall 31 and the cylindrical wall 33. As shown in FIG. 9E, the inclined portion 42 is formed between the side wall 41 and the cylindrical wall 43 of the inner case 4. The inclined portion 42 is inclined with respect to both of the side wall 41 and the cylindrical wall 43.

Further, as shown in FIG. 7, the film member 51 contacts both of the inclined portions 32 and 42 at both ends of the toner cartridge 5. The inclined portions 32 and 42 and the film member 51 are provided for preventing the toner from remaining at both ends of the toner cartridge 5.

The film member 51 has a plurality of engaging holes 51*a* arranged in the longitudinal direction of the film member 51. The engaging holes 51*a* of the film member 51 engage engaging pins 50*a* formed on the rotation member 50, so that the film member 51 is fixed to the rotation member 50.

The film member 51 also has a plurality of (for example, seven) slits 52 arranged in the longitudinal direction of the film member 51. Each of the slits 52 extends in a direction substantially perpendicular to the longitudinal direction of the film member 51 from the tip edge 510 and has a predetermined length.

The film member 51 is fixed to the rotation member in such a shape that both end portions of the film member 51 in the longitudinal direction are located ahead, in the rotating direction of the film member 51, of a center portion of the film member 51 in the longitudinal direction. To be more specific, the film member 51 is so shaped that a portion closer to either end of the film member 51 is located ahead, in the rotating direction of the film member 51, of a portion closer to the center of the film member 51. In this example, the film member 51 is divided into three parts (i.e., two side parts and a center part) in the longitudinal direction. The side parts of the film member 51 are inclined with respect to the center part, i.e., with respect to the longitudinal direction of the film member 51. Alternatively, it is also possible that the film member 51 is entirely curved.

Examples of dimensions of the toner cartridge 5 will be described with reference to FIGS. 7 and 8. An inner dimension of the toner cartridge 5 in the longitudinal direction (i.e., a distance between the side wall 31 and the side wall 41) is, for example, 249.65 mm. A gap C1 (FIG. 8) between the side wall 31 of the toner cartridge 5 and the film member 51 is, for example, 0.23 mm. A gap C2 (FIG. 7) between the side wall 41 of the toner cartridge 5 and the film member 51 is, for example, 0.46 mm.

A distance R1 (FIG. 8) from the rotation center of the rotation member 50 to the inner circumferential surface of the cylindrical wall 43 of the inner case 4 is, for example, 23.00 mm. A length from the rotation center of the rotation member 50 to the tip edge 510 of the film member 51 is, for example, 29.83 mm, which is longer than the distance R1. Therefore, the film member 51 moves in sliding contact with the inner circumferential surface of the cylindrical wall 43 of the inner case 4.

As shown in FIG. 7, the inclined portions 32 and 42 respectively have lengths L1 and L2 in the longitudinal direction of the toner cartridge 5, and have lengths L3 and L4 in a radial direction of the toner cartridge 5. The inclined portion 32 has a shape such that the length L1 is shorter than the length L3 (i.e., L1<L3). The inclined portion 42 has a shape such that the length L2 is shorter than the length L4 (i.e., L2<L4). The lengths L1 and L2 are, for example, both 2.7 mm. Further, the lengths L3 and L4 are, for example, both 10.23 mm.

An angle (obtuse angle) A1 between the inclined portion 32 and the side wall 31 (i.e., the inner side surface of the toner cartridge 5) is, for example, 165.2°. Further, an angle (obtuse angle) A2 between the inclined portion 32 and the cylindrical wall 33 (i.e., the inner circumferential surface of the toner cartridge 5) is, for example, 104.78°. Similarly, an angle B1 between the inclined portion 42 and the side wall 41 is, for example, 165.2°. Further, an angle B2 between the inclined portion 42 and the cylindrical wall 43 is, for example, 104.78°. The angles A1, A2, B1 and B2 are not limited to these values. However, it is preferable that the angle A1 is greater than the angle A2 (i.e., A1>A2), and the angle B1 is greater than the angle B2 (i.e., B1>B2) so that the toner can easily slides downward along the inclined portions 32 and 42.

The inclined portions 32 and 42 respectively have lower ends 32*a* and 42*a* connected to the inner cylindrical surface of the toner cartridge 5 (defined by the cylindrical wall of the inner case 4). A distance L5 between the lower ends 32*a* and 42*a* of the inclined portions 32 and 42 is shorter than a length L6 of the film member 51 (L5<L6). The distance L5 is also referred to as a length of a bottom portion of the toner cartridge 5 except the inclined portions 32 and 42. Further, a length L7 of the toner supply opening 35 and a length L8 of the opening 45 are shorter than the distance L5 between lower ends 32*a* and 42*a* of the inclined portions 32 and 42 (i.e., L7<L5, L8<L5).

The film member 51 (made of a polyester film in this example) has a thickness of, for example, 0.125 mm. The length L6 of the film member 51 in the longitudinal direction of the toner cartridge 5 is, for example, 241.92 mm. Although the side parts of the film member 51 are inclined with respect to the center part of the film member 51 as described above, the film member 51 has an entire length of, for example, 245.44 mm when the film member 51 is straightly stretched.

Next, a function of the toner cartridge 5 of the first embodiment will be described.

When mounting the toner cartridge 5 to the image forming unit 2, a user places the toner cartridge 5 on the image forming unit 2, and rotates the lever 44 in the direction shown by the arrow A (FIG. 6A). The inner case 4 rotates contacting the inner circumferential surface of the outer case 3, and the opening 45 of the inner case 4 is overlapped with the toner supply opening 35 of the outer case 3. Therefore, the toner supply opening 35 is opened, and the toner stored in the toner cartridge 5 is supplied to the image forming unit 2. At the same time, an engaging portion of the toner cartridge 5 engages the image forming unit 2 so that the toner cartridge 5 is fixed to the image forming unit 2.

When the image forming apparatus 10 starts an image forming operation, a rotation of the driving source is transmitted to the gear 55, and the rotation member 50 rotates. With the rotation of the rotation member 50, the film member 51 rotates contacting the inner circumferential surface of the inner case 4 (i.e., the inner circumferential surface of the cylindrical wall 43), and scrapes off the toner from the inner circumferential surface of the inner case 4. Since the film member 51 has the above described shape (FIG. 7), the toner scraped off from the inner circumferential surface of the inner case 4 by the film member 51 is led toward the center portion of the inner case 4 in the longitudinal direction, and is supplied to the image forming unit 2 via the opening 45 and the toner supply opening 35.

In this regard, in a configuration in which the film member 51 does not contact the side walls 31 and 41 of the toner cartridge 5, the toner tends to remain at both ends of the toner cartridge 5 in the longitudinal direction, i.e., near the side walls 31 and 41. However, according to the first embodiment, the inclined portions 32 and 42 are provided at both ends of the toner cartridge 5, and therefore the toner (at both ends of the toner cartridge 5) slides down along the inclined portions 32 and 42 downward, and is scraped off by the film member 51.

Figure 10A:
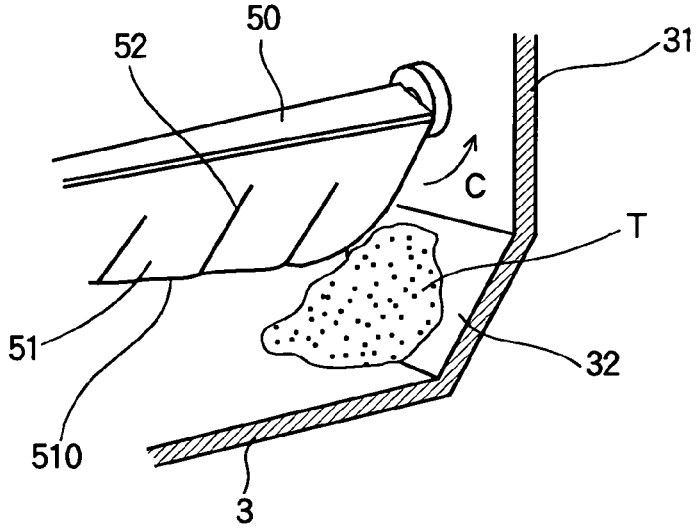
FIGS. 10A, 10B and 10C are schematic views for illustrating a function of the toner cartridge according to the first embodiment.
Figure 10B:
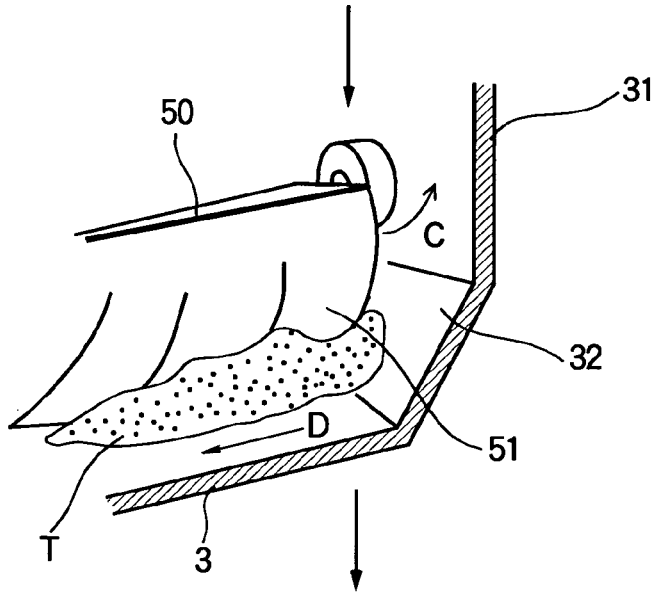
Figure 10C:
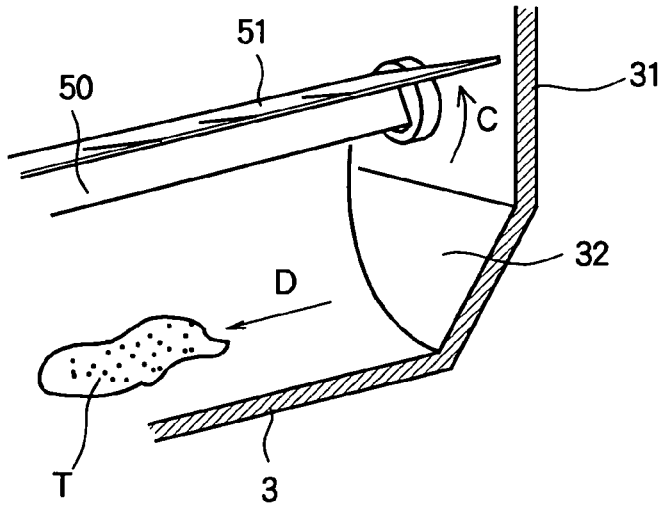

FIGS. 10A, 10B and 10C are schematic views for illustrating how the film member 51 scrapes off the toner from the inclined portion 32 of the toner cartridge 5. As shown in FIGS. 10A through 10C, the toner (indicated by a mark T) accumulated at the end of the toner cartridge 5 in the longitudinal direction easily slides down along the inclined portion 32. As the film member 51 rotates in a direction indicated by an arrow C in FIGS. 10A through 10C in such a manner that the tip edge 510 contacts the inclined portion 32, the film member 51 scrapes off the toner T having slid down along the inclined portion 32. Furthermore, since the film member 51 has a shape such that both end portions of the film member 51 in the longitudinal direction are located ahead, in the rotating direction shown by the arrow C, of the center portion of the film member 51 in the longitudinal direction, the toner scraped off by the film member 51 moves toward the center of the toner cartridge 5 in the longitudinal direction along the film member 51 as shown by an arrow D in FIGS. 10B and 10C. As a result, the toner is supplied to the image forming unit 2 via the opening 45 and the toner supply opening 35.

Although FIGS. 10A through 10C show how the toner is scraped off from the inclined portion 32, the toner is similarly scraped off from the inclined portion 42. With such a configuration, it becomes possible to prevent the toner from remaining at both ends of the toner cartridge 5 in the longitudinal direction, and to supply sufficient amount of toner to the image forming unit 2.

When detaching the toner cartridge 5 from the image forming unit 2, the user rotates the lever 44 in the direction indicated by the arrow B in FIG. 6B (i.e., an opposite direction to that when the toner cartridge 5 is mounted). As the inner case 4 rotates in the direction indicated by the arrow B, the toner supply opening 35 is closed, and the engaging portion of the toner cartridge 5 is disengaged from the image forming unit 2, so that the toner cartridge 5 becomes detachable from the image forming unit 2.

In the above described configuration, gaps are provided between the film member 51 and both side walls 31 and 41 of the toner cartridge 5. However, it is also possible that the film member 51 contacts both of or either one of the side walls 31 and 41 of the toner cartridge 5. In such a case, the toner adhering to the side walls 31 and 41 can be directly scraped off by the film member 51, as well as the toner adhering to the inclined portion 32 and 42. In contrast, when the gaps are provided between the film member 51 and both side walls 31 and 41 of the toner cartridge 5 as shown in FIG. 7, a rotation load on the film member 51 can be reduced.

As described above, according to the first embodiment of the present invention, the toner cartridge 5 has the inclined portions 32 and 42 at both ends in the longitudinal direction. Further, the film member 51 is configured to contact the inclined portions 32 and 42, and to lead the toner adhering to the inclined portions 32 and 42 to the center portion of the toner cartridge 5. Therefore, it becomes possible to prevent the toner from remaining at both ends of the toner cartridge 5 in the longitudinal direction, and to supply sufficient amount of toner to the image forming unit 2.

Particularly, the obtuse angle A1 between the inclined portion 32 and the side wall 31 is greater than the obtuse angle A2 between the inclined portion 32 and the cylindrical wall 33, and the obtuse angle B1 between the inclined portion 42 and the side wall 41 is greater than the obtuse angle B2 between the inclined portion 42 and the cylindrical wall 43, with the result that the toner easily slides down along the inclined portions 32 and 42. Therefore, it becomes possible to effectively prevent the toner from remaining at both ends of the toner cartridge 5.

Further, the film member 51 is so shaped that both end portions of the film member 51 in the longitudinal direction are located ahead, in the rotating direction of the film member 51, of the center portion of the film member 51 in the longitudinal direction, and therefore the toner scraped off from the inclined portion 32 and 42 can effectively be led to the center portion of the toner cartridge 5 in the longitudinal direction.

Furthermore, the film member 51 has a plurality of slits 52, and therefore the film member 51 can be deformed according to shapes of the inclined portions 32 and 42. Thus, the film member 51 can smoothly scrapes off the toner from the inclined portions 32 and 42.

Moreover, the distance L5 between the lower ends 32*a* and 42*a* of the inclined portions 32 and 42 is shorter than the length of the film member 51, and therefore the film member 51 contacts at least part of the inclined portions 32 and 42. Thus, it is ensured that the film member 51 scrapes off the toner from the inclined portions 32 and 42.

In the above described toner cartridge 5, the outer case 3 has the inclined portion 32 and the inner case 4 has the inclined portion 42. However, the first embodiment is not limited to such a configuration. It is only necessary that the toner cartridge 5 has inclined portions at both ends in the longitudinal direction.

Although the toner cartridge 5 as the developer storage body is configured to be detachable (replaceable) and to supply the toner to the image forming unit 2, it is also possible that the developer storage body includes a collection container for collecting waste toner (i.e., a waste developer) as well as the toner cartridge 5.

Second Embodiment

Figure 11:
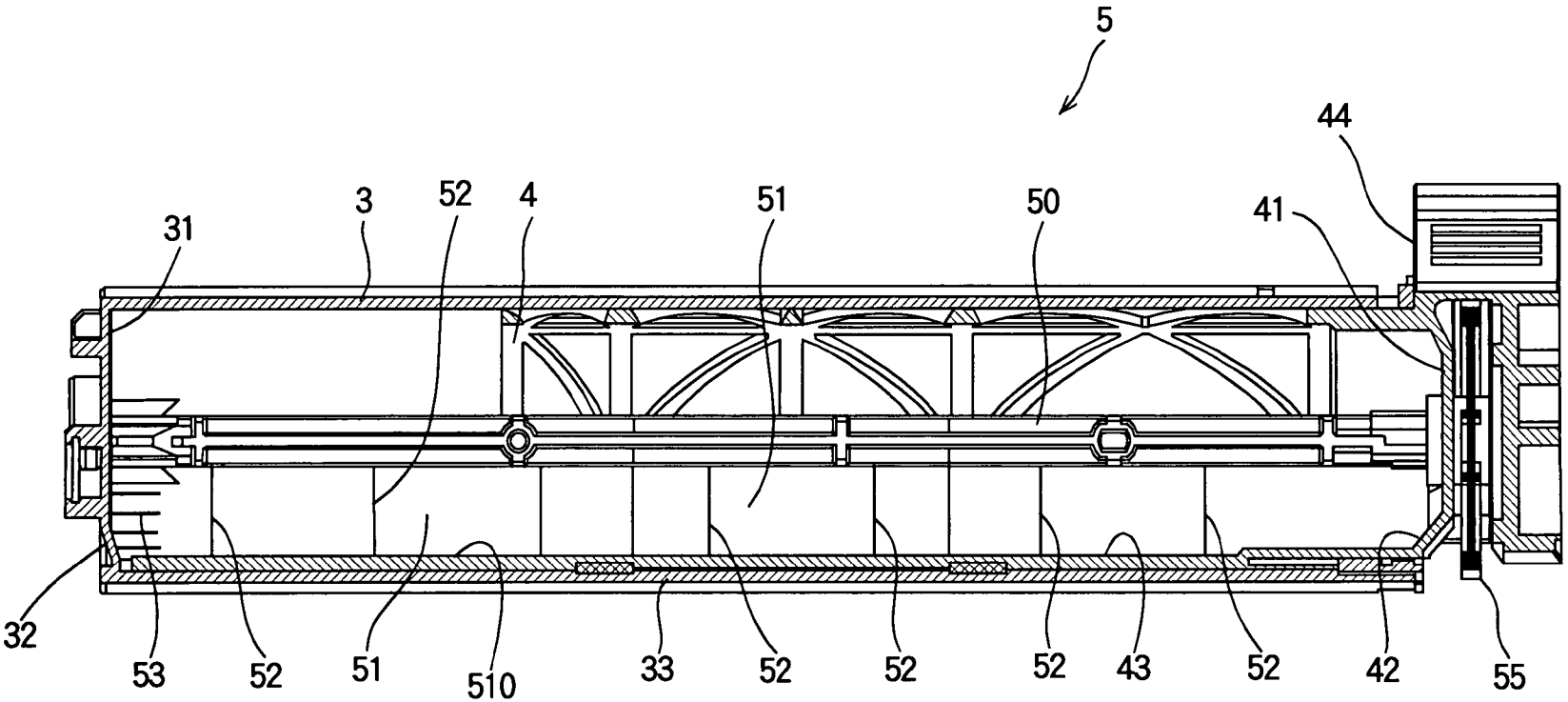
FIG. 11 is a sectional view showing a configuration of a toner cartridge according to the second embodiment of the present invention.

FIG. 11 is a sectional view showing a toner cartridge 5 according to the second embodiment of the present invention. The toner cartridge 5 of the second embodiment is different from that of the first embodiment in the shape of the film member 51. The following description will be focused on the difference from the first embodiment, and explanations of the elements that are the same as those of the first embodiment will be omitted.

Further, the image forming apparatus 1 of the second embodiment is the same as that of the first embodiment except the shape of the film member 51 of the toner cartridge 5, and therefore explanations of configuration and operation of the image forming apparatus 1 will be omitted.

In the second embodiment, a side end edge of the film member 51 in the longitudinal direction contacts the side wall 31 of the toner cartridge 4. Further, slits 53 are formed on the side end edge of the film member 51. To be more specific, a plurality of (in this example, four) slits 53 are arranged in a widthwise direction of the film member 51. Each slit 53 extends in the longitudinal direction of the film member 51, i.e., the longitudinal direction of the toner cartridge 5.

The other side end edge of the film member 51 is apart from the side wall 41 as in the first embodiment. However, it is also possible that this side end edge of the film member 51 contacts the side wall 41 and has slits 53.

The function of the toner cartridge 5 of the second embodiment is substantially the same as that of the first embodiment. To be more specific, in the second embodiment, the film member 51 rotates in such a manner that the side end edge of the film member 51 contacts the side wall 31. That is, the film member 51 rotates contacting the side wall 31, the inner circumferential surface of the inner case 4 and the inclined portions 32 and 42. Therefore, the film member 51 scrapes off the toner from the side wall 31, the inner circumferential surface of the inner case 4 and the inclined portions 32 and 42, and supplies the toner to the image forming unit 2 via the opening 45 and the toner supply opening 35.

As described above, according to the second embodiment, the film member 51 is configured to contact at least one of the side walls 31 and 41. Therefore, the film member 51 does not only scrape off the toner adhering to the inclined portions 32 and 42, but also scrapes off the toner adhering to the side wall(s) of the toner cartridge 5. The scraped toner is supplied to the image forming unit 2. Thus, it becomes possible to effectively prevent the toner from remaining at both ends of the toner cartridge 5.

Further, the slits 53 are formed on a contact portion (i.e., the side end edge) of the film member 51 contacting the side wall 31, and therefore the contact portion can be easily deformed according to the shape of the inclined portion 32 and the side wall 31. Thus, the toner can be smoothly scraped off from the inclined portion 32 and the side wall 31.

The present invention is applicable to an image forming apparatus such as a printer, a facsimile machine, a copier, or a combined machine having a plurality of functions thereof.

While the preferred embodiments of the present invention have been illustrated in detail, it should be apparent that modifications and improvements may be made to the invention without departing from the spirit and scope of the invention as described in the following claims.

What is claimed is:

1. A developer storage body comprising:

a developer storage portion storing a developer and having an elongated shape;

an outlet opening provided at a substantially center portion of said developer storage portion in a longitudinal direction of said developer storage portion;

inclined portions provided on both of two end portions of said developer storage portion in said longitudinal direction;

a rotation member rotatably provided in said developer storage portion; and a film member provided on said rotation member, said film member being brought into contact with said inclined portions when said rotation member rotates, said film member having a substantially rectangular shape, said film member having corner portions that directly contact said inclined portions when said rotation member rotates, and when said corner portions of said film member directly contact said inclined portions, said corner portions are deflected, and surfaces of said corner portions slide along said inclined portions.

2. The developer storage body according to claim 1, wherein, when said rotation member rotates, said film member contacts an inner circumferential surface of said developer storage portion.

3. The developer storage body according to claim 1, wherein a distance between lower ends of said inclined portions of said developer storage portion is shorter than a length of said film member.

4. The developer storage body according to claim 1, wherein a distance between lower ends of said inclined portions of said developer storage portion is longer than a length of said outlet opening.

5. The developer storage body according to claim 1, wherein an obtuse angle between said inclined portion and an inner side surface of said developer storage portion is greater than an obtuse angle between said inclined portion and an inner circumferential surface of said developer storage portion.

6. The developer storage body according to claim 1, wherein said film member is mounted to said rotation member and shaped so that both end portions of said film member in a longitudinal direction of said film member are located ahead, in a rotating direction of said film member, of a center portion of said film member in said longitudinal direction of said film member.

7. The developer storage body according to claim 6, wherein said film member is shaped so as to lead said developer toward said center portion of said developer storage portion in said longitudinal direction of said developer storage portion by a rotation of said film member.

8. The developer storage body according to claim 1, wherein said film member has a plurality of slits extending substantially perpendicular to a longitudinal direction of said film member.

9. The developer storage body according to claim 1, wherein an end edge of said film member contacts an inner end surface of said developer storage portion.

10. The developer storage body according to claim 1, wherein a slit extends from an end edge of said film member and extends substantially parallel to a longitudinal direction of said film member.

11. The developer storage body according to claim 1, wherein the developer storage body further comprises two inner side surfaces;

wherein said rotation member has both end portions in a longitudinal direction thereof, said end portions of said rotation member being supported at both of the two inner side surfaces; and wherein said rotation member has a gear fixed to one of said end portions, said gear being provided for rotating said rotation member.

12. The developer storage body according to claim 1, wherein each of said inclined portions has a length in said longitudinal direction of said developer storage portion which is shorter than that in a direction perpendicular to said longitudinal direction of said developer storage portion.

13. A developing device comprising:

said developer storage body according to claim 1.

14. An image forming apparatus comprising:

said developing device according to claim 13.

15. The developer storage body according to claim 1, wherein said surfaces of said corner portions are disposed so as to lead said developer from said inclined portions toward said substantially center portion of said developer storage portion.

16. The developer storage body according to claim 15, wherein in an overhead view of the developer storage body and along a rotation direction of the film member, said corners are disposed ahead of a substantially center portion of said film member.

17. The developer storage body according to claim 1, wherein said rotation member has a plurality of engaging pins, wherein said film member has a plurality of engaging holes arranged in a longitudinal direction of said film member, and wherein said film member is fixed to said rotation member by engagement between said engaging pins and said engaging holes.

18. The developer storage body according to claim 17, wherein said film member is fixed to a front side of said rotation member in a rotating direction of said rotation member.

* * * * *